US006878021B1

(12) United States Patent
Thai

(10) Patent No.: US 6,878,021 B1
(45) Date of Patent: Apr. 12, 2005

(54) SEAHORSE

(76) Inventor: Thanh Thai, 1143 Port Sunlight Ct., Henderson, NV (US) 89014

( * ) Notice: Subject to any disclaimer, the term of this patent is extended or adjusted under 35 U.S.C. 154(b) by 0 days.

(21) Appl. No.: 10/659,318

(22) Filed: Sep. 11, 2003

(51) Int. Cl.[7] ..... B63B 11/12
(52) U.S. Cl. ..... 440/44; 114/55.57; 114/352
(58) Field of Search ..... 440/44; 114/55.5, 114/55.57, 77 R, 352

(56) References Cited

U.S. PATENT DOCUMENTS 1,837,508 A * 12/1931 Volf, Jr. ..... 114/289
1,891,602 A * 12/1932 Neill ..... 114/77 R
2,233,231 A * 2/1941 Vincent ..... 440/44
5,433,164 A * 7/1995 Sneath ..... 114/315

* cited by examiner

*Primary Examiner*—Sherman Basinger
(74) *Attorney, Agent, or Firm*—Patent & Trademark Services, Inc; Joseph H. McGlynn

(57) ABSTRACT

A water craft that is made in three units which are connected together. The dimensions of the units can be varied to carry different size users. A motor that forces air through a tube is mounted in one of the units and air passageways lead from the motor to another unit. The water craft has two different steering mechanisms and exterior fins to control the craft.

19 Claims, 4 Drawing Sheets

SEAHORSE

BACKGROUND OF THE INVENTION

This invention relates, in general, to water craft, and, in particular, to a personal water craft with a variety of propulsion units that adapt it to swimming pools or larger bodies of water.

SUMMARY OF THE INVENTION

The present invention is directed to a water craft that is made in three units which are connected together. The dimensions of the units can be varied to carry different size users. A motor that forces air through a tube is mounted in one of the units and air passageways lead from the motor to another unit. The water craft has two different steering mechanisms and exterior fins to control the craft.

It is an object of the present invention to provide a new and improved watercraft that can carry different size users.

It is an object of the present invention to provide a new and improved watercraft that can be propelled by a variety of mechanisms.

It is an object of the present invention to provide a new and improved watercraft that is naturally buoyant.

These and other objects and advantages of the present invention will be fully apparent from the following description, when taken in connection with the annexed drawings.

DESCRIPTION OF THE PREFERRED EMBODIMENT

Figure 1:
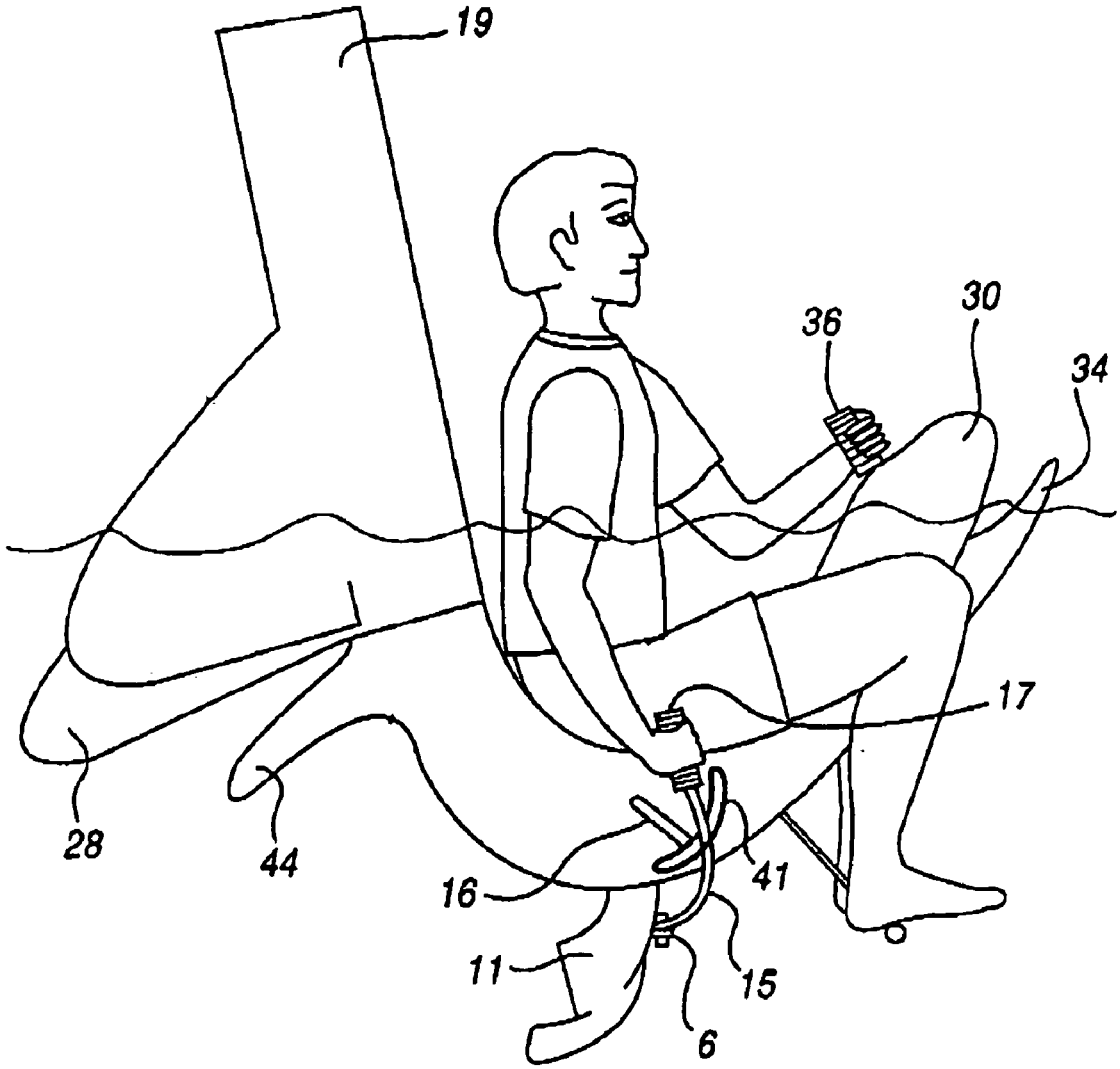
FIG. 1 is a perspective view of the present invention.

Referring now to the drawings in greater detail, FIG. 1 shows the watercraft of the present invention. The watercraft has a middle section, a back section 19, and a front section 30. The watercraft is shaped generally like a J, and a user can sit in the curved section of the J. Each of the three sections are detachable from each other, as will be explained more fully below. The detachability feature will allow different size sections to be assembled with each other to support different size users and/or to support more than one user.

Figure 2:
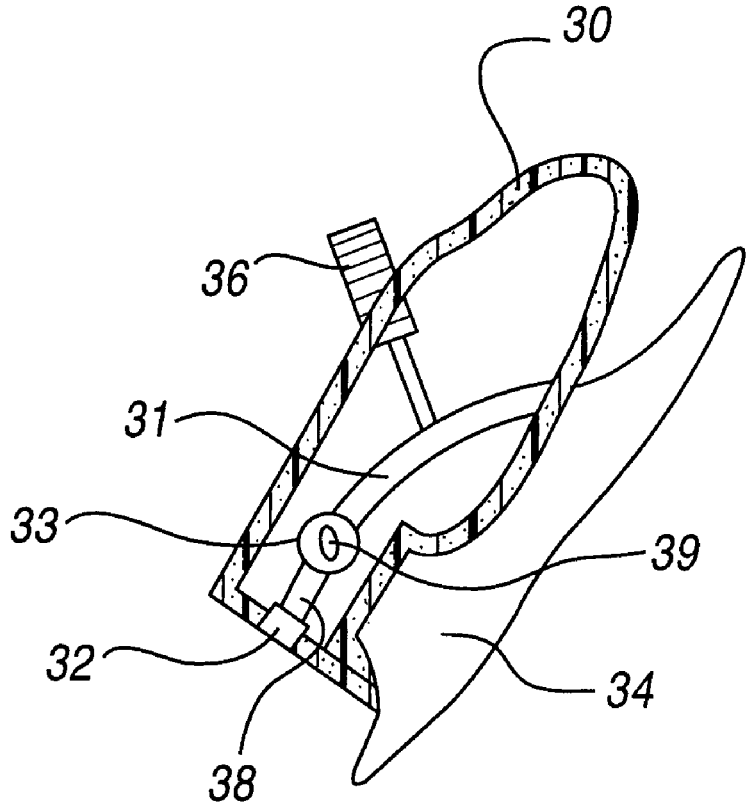
FIG. 2 is a cross-sectional view of the front portion of the present invention.

As shown in FIG. 2, the front section 30 of the watercraft has a foam outer covering to provide flotation and center strength frames 31, 38. The frame 31 has a steering handle 36 connected thereto in any conventional manner. The steering handle 36 will allow the user to move the front of the watercraft right or left during use. A steering fin 34 is secured to the front of the foam body section 30 to help the user steer the craft. The fin 34 can be unitary or integral with the body 30. The frames 31, 38 can be made from any type of material that will serve the intended purpose and has a connector 32 for connecting the frame 38 with the frame member 2 in the center or middle section of the watercraft. The connector 32 can be any conventional detachable connector such as, but not limited to, a threaded ring, a bayonet ring, or a snap fit connector.

Figure 5:
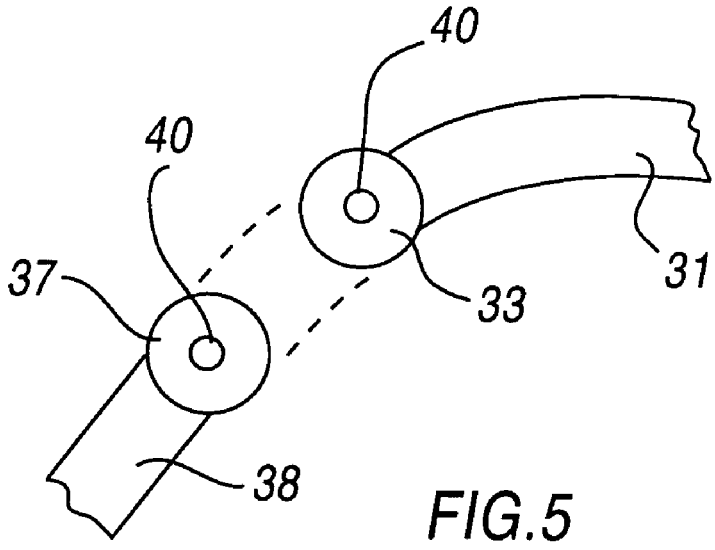
FIG. 5 is a partial view of the adjustment feature of the front portion of the present invention.

In addition, the frames 31, 38 have adjustment knobs 33, 37 to adjust the front portion 30 up and down to accommodate the size of the user. As shown in FIG. 5, frame member 31 has a disk like knob 33 attached at one end. Frame member 38 has a disk like knob 37 attached at one end. The two knobs 33, 37 are superimposed and secured together by a threaded fastener passed through apertures 40, and when the fastener 39 is tightened it will hold the knobs 33, 37, and the frames 31, 32, in any position they are placed in. Therefore, if a user needs more room between the front portion 30 and the rear portion 19, he/she could loosen the fastener 39 and move frame 31 clockwise as seen in FIG. 2. Then by tightening fastener 39, the frame member could be held in its new position. If a user needs less room between the front portion 30 and the rear portion 19, he/she could loosen the fastener 39 and move frame 31 counterclockwise as seen in FIG. 2. Then by tightening fastener 39, the frame member could be held in its new position. Since the foam material that makes up front portion 30 is a flexible material, it will accept the relative movement of the frame members 38, 31.

Figure 3:
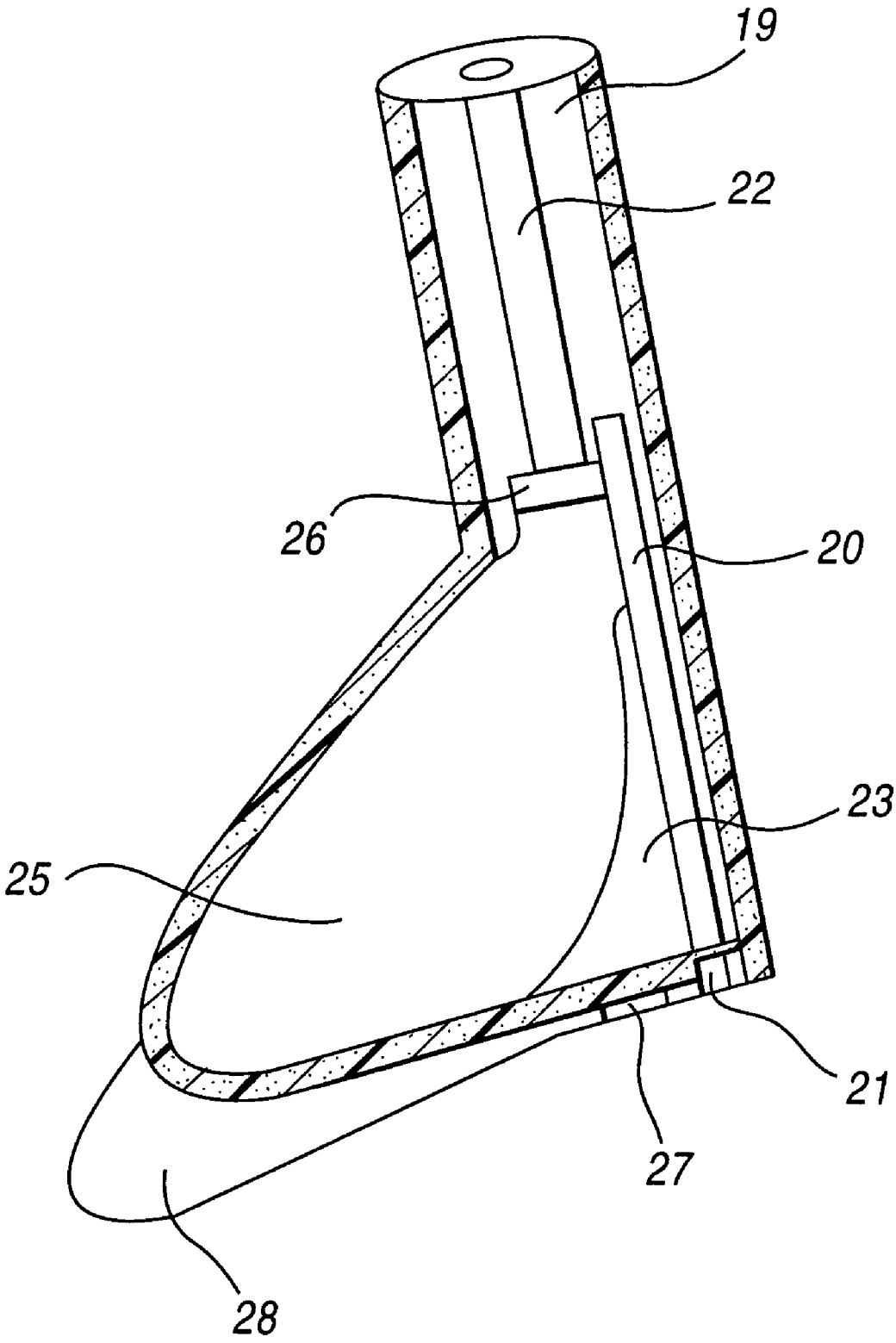
FIG. 3 is a cross-sectional view of the back portion of the present invention.

FIG. 3 shows the back section of the watercraft which has a foam outer covering 19 for floatation, and a center strength frame 20, which essentially serve the same purpose as the foam 30 and frame 31 in FIG. 2. An air channel or pipe 22 leads from the top of the back section to a motor 25. The pipe 22 is connected to the motor by a valve 26 which allows air to move only one way through the valve. A motor brace 23 is secured to the frame 23 in any conventional manner. The brace engages against the side of the motor 25 to stabilize and support the motor. If necessary another brace could be applied to the other side of the motor 25. A foam motor support 28 is attached to the back, bottom portion of the back section 19. A mechanical connector 21, similar to connector 32 on the front section, is used to connect the back section frame 20 to the middle section frame 2. An air outlet 27 allows air from the motor 25 to be blown into the air pipe or channel 3 on the center section.

A DC (battery operated) motor can be used to power the water craft, or a more powerful gas motor can be used, as long as the motor can blow enough air to move the watercraft.

Figure 4:
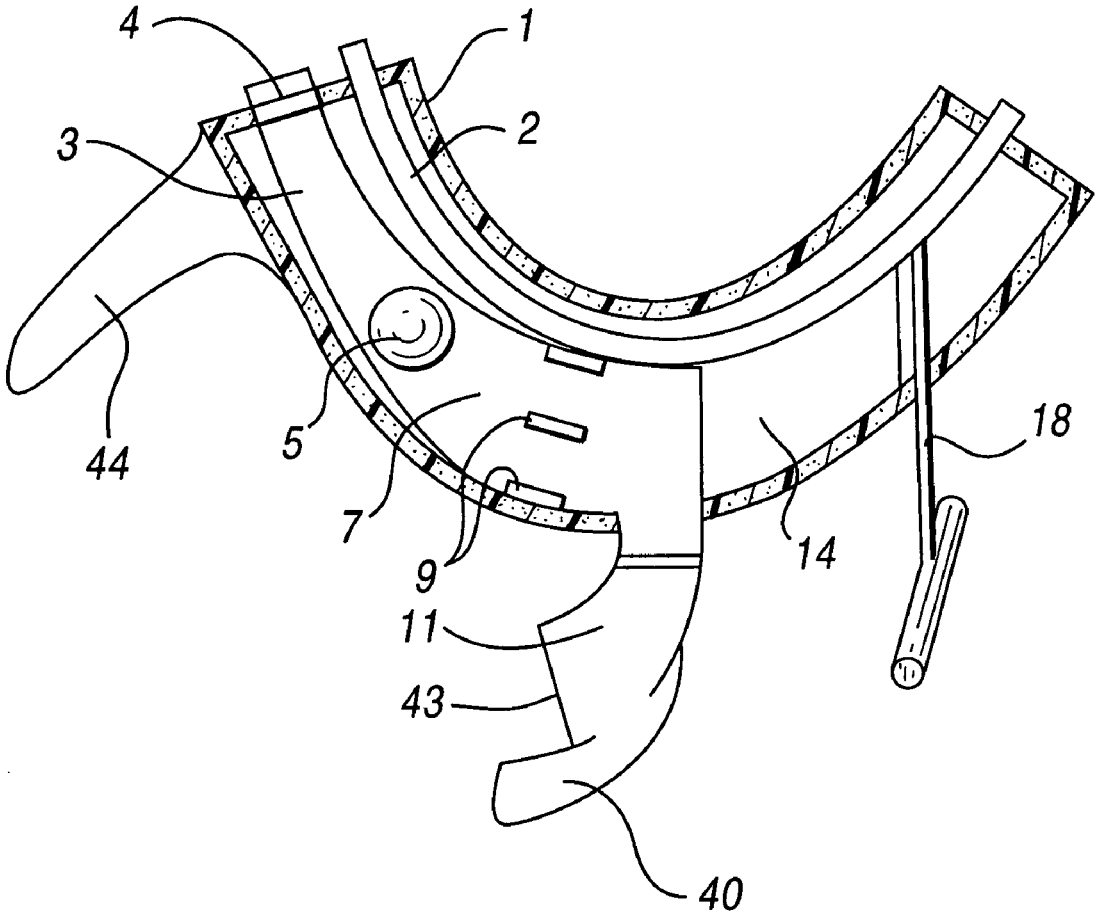
FIG. 4 is a cross-sectional view of the middle portion of the present invention.

FIG. 4 shows the center or middle section of the watercraft. This section has a foam outer covering 1, similar to 19 and 30. The center section also has a strength frame 2, similar to frames 20 and 31, 38 and a stabilizing fin 44 similar to fin 34. Air pipe 3 is connected to outlet 27 by conventional connector 4. Air pipe 3 is narrow at the top of the middle section and widens at it approaches the bottom or curved part of the middle section.

Inside the pipe 3 is a ball 5 which has a diameter larger than the top portion of the pipe, and a diameter smaller than the bottom portion of the pipe. Positioned internally of the pipe 3, near the bottom of the pipe, is a plurality of bars 9. The bars make this section of the pipe smaller than the diameter of the ball 5 so the ball will not move all the way down into the pipe 3 and block the outlet port 43. If water enters the outlet port 43, the water will force the ball 5 toward the top of the pipe 3. When the ball is forced into the smaller portion of the pipe, it will block the pipe and prevent water from reaching the motor 25.

As air is forced down the pipe 3 from the motor 25, the ball 5 will be forced down until it encounters the bars 9. The bars 9 will hold the ball in a portion of the pipe 3 that is larger than the diameter of the ball 5, thereby allowing air to pass around the ball and exit through the outlet port 43 in the outlet module 11. The air exiting the outlet 43 will propel the watercraft through the water.

Attached to the frame member 2 is a foot rest 18 for the user's feet. The foot rest can be made detachable if desired. Also, the length of the foot rest can be made adjustable to fit different size riders. The foot rest servers the purpose of allowing the user to tuck their legs and feet in a manner that will reduce drag on the watercraft.

A compartment 14 is placed between the foot rest 18 and the pipe 3 to receive a battery (not shown) to operate the motor 25. Conventional electric wires (not shown) would be run between the battery and the motor. In addition, the compartment 14 can receive weights, if necessary, to balance the watercraft. Also, a conventional access door (not shown) would be provided so a user can have access to the compartment, for changing or charging the battery when necessary. Obviously the door would have a seal to keep the compartment water tight.

As shown in FIG. 1, a control mechanism is attached to the outlet module 11. This control mechanism is not shown in FIG. 4 for clarity. A rod 16 is attached to the center section and projects substantially perpendicularly therefrom. The rod has an end section 41 that is curved and has a slot formed to accept the control handle 17. The control handle has a portion 15 which connects to the outlet module 11 in any conventional manner. By moving the handle 17 to the right side of the slot a user can shift the craft to the right, and by moving the handle 17 to the left side of the slot a user can shift the craft to the left.

Although the Seahorse and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A watercraft comprising:

a front section, a middle section and a back section, means for detachably connecting said front section to said middle section, and means for detachably connecting said back section to said middle section, and motor means for propelling said watercraft, said motor means having an air inlet in said back section, and said air inlet communicating with a air passageway in said middle section, and an air outlet port in said middle section, and wherein said front section, said middle section and said back section form a J shape.

2. The watercraft as claimed in claim 1, wherein said motor means is mounted in said back section.

3. The watercraft as claimed in claim 1, wherein said air passageway has means for connecting said air passageway to said air inlet, and said air passageway tapers from adjacent said back section to a point remote from said back section.

4. The watercraft as claimed in claim 3, wherein said air passageway has a narrow portion adjacent said back section and a wider portion at a point remote from said back section.

5. The watercraft as claimed in claim 4, wherein air is propelled from said motor means through said narrow portion toward said wider portion, and said air passageway has means for blocking said air passageway.

6. The watercraft as claimed in claim 5, wherein said means for blocking said air passageway is a ball.

7. The watercraft as claimed in claim 6, wherein said ball has a diameter, and said diameter is larger than said narrow portion and smaller than said wider portion.

8. The watercraft as claimed in claim 6, wherein said air passageway has an air outlet, and means for blocking said ball from moving to a position where it blocks said air outlet.

9. The watercraft as claimed in claim 8, wherein said means for blocking said ball is a plurality of bars.

10. The watercraft as claimed in claim 9, wherein said bars are spaced around an internal circumference of said air passageway.

11. The watercraft as claimed in claim 1, wherein said front section has a steering handle attached thereto, and said middle section has a steering handle attached thereto.

12. The watercraft as claimed in claim 11, wherein said middle section has a support rod for said steering handle, and said support rod has an elongated end with a slot extending therethrough, and said steering handle extends through said slot.

13. The watercraft as claimed in claim 12, wherein said steering handle has a hand grip on one end and an opposite end is connected to said air outlet port.

14. The watercraft as claimed in claim 1, wherein said middle section has a foot rest attached thereto.

15. The watercraft as claimed in claim 14, wherein said middle section has a compartment positioned between said foot rest and said air outlet port.

16. The watercraft as claimed in claim 1, wherein each of said front section, said middle section and said back section has an outer foam body covering a center strength frame.

17. The watercraft as claimed in claim 16, wherein said center strength frame of said front section is made in two parts and has an adjustment means for adjusting said two parts in relation to each other.

18. The watercraft as claimed in claim 17, wherein said adjustment means comprises a disk attached to one of said two parts, and a second disk attached to another of said two parts, each of said disks having an aperture extending therethrough, and a fastener means extending through said apertures for tightening said disks together.

19. A watercraft comprising:

a front section, a middle section and a back section, means for detachably connecting said front section to said middle section, and means for detachably connecting said back section to said middle section, and motor means for propelling said watercraft, said motor means having an air inlet in said back section, and said air inlet communicating with a air passageway in said middle section, and an air outlet port in said middle section, and wherein said front section has a steering fin attached thereto and said middle section has a stabilizing fin attached thereto.

* * * * *